United States Patent [19]

Higashio et al.

[11] Patent Number: 4,990,954

[45] Date of Patent: Feb. 5, 1991

[54] IMAGE FORMING APPARATUS HAVING DETACHABLE DATA STORAGE UNIT

[75] Inventors: Kimihiko Higashio; Masazumi Ito, both of Osaka, Japan

[73] Assignee: Minolta Camera Kabushiki Kaisha, Osaka, Japan

[21] Appl. No.: 253,587

[22] Filed: Oct. 5, 1988

[30] Foreign Application Priority Data

Oct. 6, 1987 [JP] Japan ..... 62-251791

[51] Int. Cl.[5] ..... G03G 15/00

[52] U.S. Cl. ..... 355/200; 355/313

[58] Field of Search ..... 355/200, 203, 204, 208, 355/209, 313, 314

[56] References Cited

U.S. PATENT DOCUMENTS

| | | | |
|---|---|---|---|
| 4,442,505 | 4/1984 | Takano | 355/313 |
| 4,453,821 | 6/1984 | Smith | 355/313 |
| 4,543,643 | 9/1985 | Shibazaki et al. | 364/900 |
| 4,653,899 | 3/1987 | Watanabe | 355/218 |
| 4,711,560 | 12/1987 | Hosaka et al. | 355/200 |
| 4,764,789 | 8/1988 | Iwaki et al. | 355/209 |
| 4,809,041 | 2/1989 | Funada | 355/313 |

FOREIGN PATENT DOCUMENTS

| | | | |
|---|---|---|---|
| 59-188682 | 10/1984 | Japan | 355/313 |

*Primary Examiner*—Joan H. Pendegrass

*Attorney, Agent, or Firm*—Burns, Doane, Swecker & Mathis

[57] ABSTRACT

An improved image forming apparatus, for example, in the form of a copying apparatus is arranged to selectively load data of a specific mode from data of a plurality of modes stored in a memory medium through operation of an operating input device such as key switches or the like. The apparatus is particularly capable of readily loading data of the desired mode from the memory medium.

8 Claims, 6 Drawing Sheets

IMAGE FORMING APPARATUS HAVING DETACHABLE DATA STORAGE UNIT

BACKGROUND OF THE INVENTION

The present invention generally relates to an image forming arrangement and more particularly, to an image forming apparatus such as an electrophotographic copying apparatus or the like arranged to effect control, for example, based on data memorized in an IC card, etc.

It has been a recent trend that an image forming apparatus e.g. a copying apparatus is provided with various functions such as continuous page copying, duplex copying, color copying anamorphic magnification copying, image editing copying, or the like. Following such a tendency, operation of the copying apparatus has been complicated, thus making it necessary to set various copying conditions, for example, to select a desired mode from various modes or to set various numerical values, through operation of many input keys provided on the surface of a control panel.

In order to cope with the complication of the operation as described above, there has been proposed a copying apparatus so arranged that data for desired copying conditions are preliminarily stored in a memory medium e.g. a non-volatile memory, IC card or the like in the copying apparatus, so as to be read out from the memory medium during copying for being loaded in a working area of an internal memory device.

In the known arrangement as referred to above, however, when data for only one kind of mode is stored in such memory medium, the loading may be readily effected, but if data of a plurality of modes are stored therein, it becomes necessary to provide a measure for enabling selection of a desired mode from the data of the plurality of modes.

For the purpose as referred to above, there may be considered a practice, for example, to provide key switches by the number for the kinds of the modes stored in the memory medium, thereby to load the data of a predetermined mode through depression of the key switch equivalent thereto. In such a practice, however, not only are many key switches required, thus complicating the surface arrangement of the control panel, but cost increase is undesirably involved.

SUMMARY OF THE INVENTION

Accordingly, an essential object of the present invention is to provide an improved image forming apparatus arranged to selectively load data of a specific mode from data of a plurality of modes stored in a memory medium through operation of an operating input means such as key switches or the like, and particularly capable of readily loading data of the desired mode.

Another object of the present invention is to provide an image forming apparatus of the above described type which is simple in construction and stable in functioning at high reliability.

In accomplishing these and other objects, according to one preferred embodiment of the present invention, there is provided an image forming apparatus arranged to selectively load data of a specific mode from data of a plurality of modes stored in a memory medium, through operation of an operating input means, and is characterized in that there are provided a selecting control means for successively selecting data of various modes within said memory medium by each one operation of said operating input means, and a display control means for displaying an identification symbol of the mode selected by said selecting control means on a display portion during operation of said operating input means.

More specifically, the image forming apparatus in the form of a copying apparatus according to the present invention includes an image forming device for forming an image on a copy paper by designated one mode of a plurality of functioning modes, a memory device detachable with respect to the image forming device and storing a plurality of data for setting the functioning mode of said image forming device, with the respective data being adapted to correspond to predetermined identification symbols, a mode selection device for selecting one of the data stored in the memory device when said memory device is mounted with respect to said image forming device, and a display device for displaying the identification symbols corresponding to the selected data.

By the arrangement according to the present invention as described above, through operation of the control input means, the data of one of the modes in the data of the plurality of modes stored in the memory medium is loaded in the internal memory device of the image forming apparatus. Each time the operating input means is operated, each mode within the memory medium is successively selected in a manner as in rotation, and during operation of the operating input means, e.g. while the key switch is being depressed, an identification symbol of the mode selected at that time is displayed on the display portion. As the display portion, a display device for displaying the number of copies to be taken, copying magnifications, etc. may be commonly used for the purpose also.

BRIEF DESCRIPTION OF THE DRAWINGS

These and other objects and features of the present invention will become apparent from the following description taken in conjuction with the preferred embodiment thereof with reference to the accompanying drawings, in which.

DETAILED DESCRIPTION OF THE INVENTION

Figure 1:
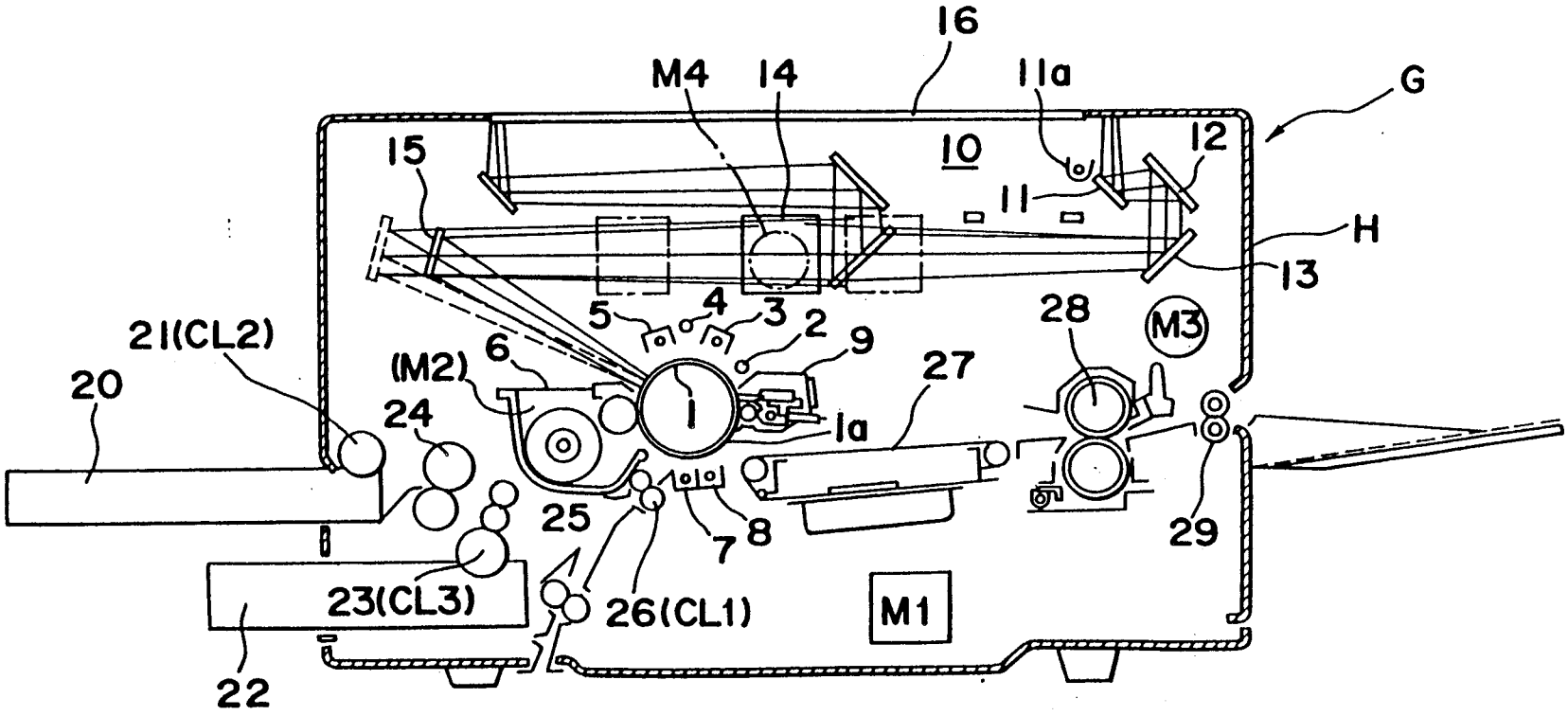
FIG. 1 is a schematic side sectional view of an electrophotographic copying apparatus to which the present invention may be applied.

Before the description of the present invention proceeds, it is to be noted that like parts are designated by like reference numerals throughout the accompanying drawings.

Referring now to the drawings, there is shown in FIG. 1 an image forming apparatus in the form of an electrophotographic copying apparatus to which the present invention may be applied.

In FIG. 1, the copying apparatus G generally includes a photosensitive or photoreceptor drum 1 having a photoconductive layer 1*a* around its peripheral surface, and rotatably provided generally at a central portion of an apparatus housing H, and various processing stations such as a main eraser lamp 2, a sub-corona charger 3, a sub-erase lamp 4, a main corona charger 5, a developing device 6, a transfer charger 7, a copy paper sheet separating charger 8, and a blade type cleaning device 9, etc. which are sequentially disposed around the photoreceptor drum 1 for effecting the electrophotographic processing. The photoconductive surface 1*a* of a photoreceptor drum 1 is uniformly charged as it passes through the eraser lamps 2 and 4, and the corona chargers 3 and 5, and is then, subjected to image exposure through an optical system 10 to be described hereinbelow.

The optical system 10 referred to above and movably disposed for scanning an original document, in a position below and adjacent to an original document platform 16 of a transparent material provided at the upper portion of the apparatus housing H, includes a light source 11*a*, movable mirrors 11, 12 and 13, a lens assembly 14, and another movable mirror 15. The light source 11*a* and the movable mirror 11 are arranged to move at a speed of V/n (where n is the copying magnification) with respect to a peripheral speed V of the photoreceptor drum 1, while the movable mirrors 12 and 13 are driven to move at a speed of V/2n by a scan motor M3.

Meanwhile, at the left side of the apparatus housing H, there are provided upper and lower paper feeding sections 20 and 22 respectively provided with paper feeding rollers 21 and 23, and sets of transport rollers 24 and 25, and a pair of timing rollers 26, a transport belt 27 movably supported by rollers, a fixing device 28, and a pair of discharge rollers 29, which are disposed along a transport passage of copy paper sheets.

Figure 2:
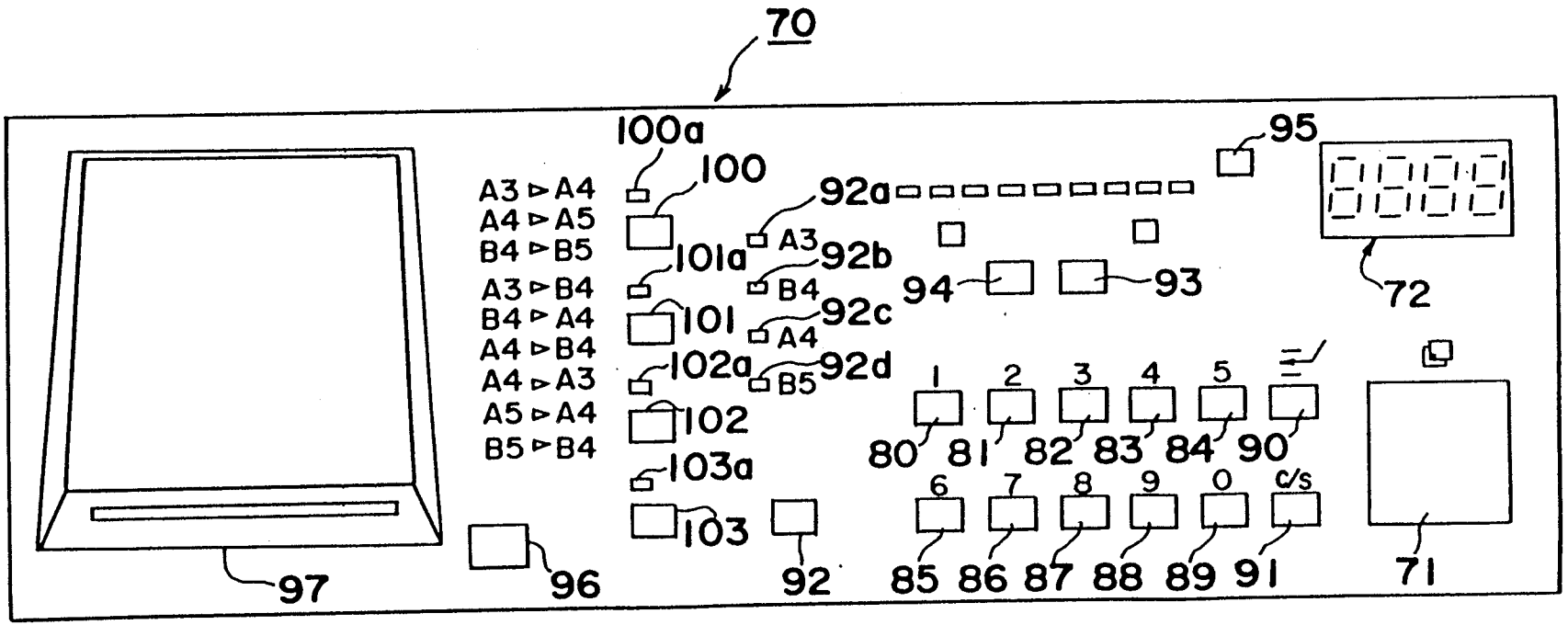
FIG. 2 is a top plan view of a control panel for the copying apparatus of FIG. 1.

Referring also to FIG. 2, there is shown a top plan view of a control panel 70 for the copying apparatus G as described so far. On the control panel 70, there are provided a print key 71 for starting the copying function, a sheet number display portion 72 constituted by a seven segment LED for displaying the number of copies to be taken, ten-keys 80 to 89 respectively corresponding to numerical values 1,2, . . . 9 and 0, an interruption key 90 for designating the interruption copying, a clear stop key 91, a paper selection key 92 for selecting the upper paper feeding section 20 or lower paper feeding section 22, paper size display portions 92*a*, 92*b*, and 92*d* for displaying sizes of copy paper sheets accommodated in the selected paper feeding section, up and down keys 93 and 94 for altering and designating density of copied image stepwise, and all clear key 95, a mode memory load key 96, an IC card inserting slot 97, magnification selecting keys 100 to 103, and magnification display portions 100*a* to 103*a* for displaying the magnifications as selected, etc.

Figure 3:
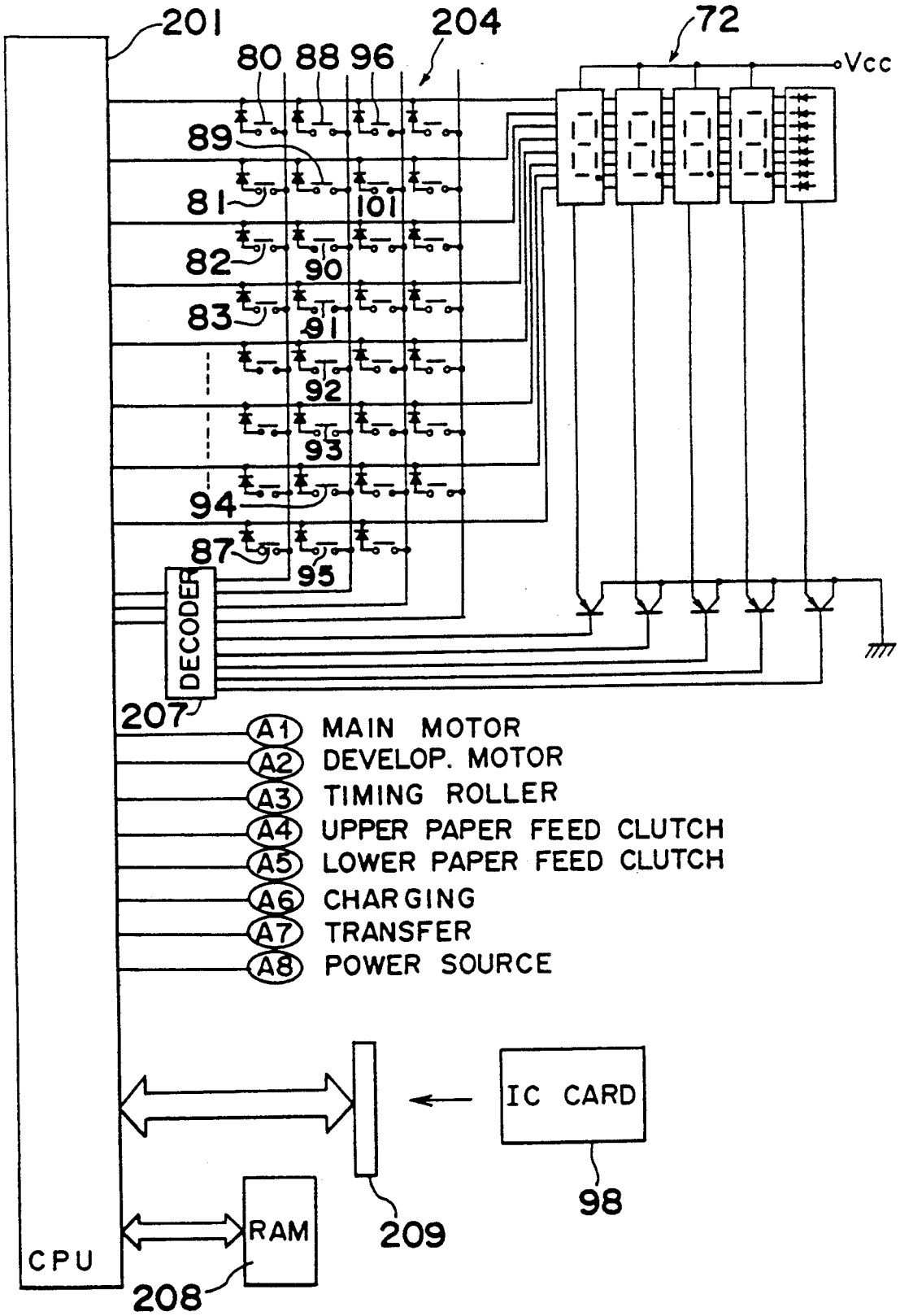
FIG. 3 is a circuit diagram showing a control circuit for the copying apparatus of FIG. 1, FIGS. 4 and 5 are flow charts showing control functions of the copying apparatus, FIGS. 6(*a*) 6(*b*), and 6(*c*) are diagrams showing examples of identification symbols to be displayed on a copy sheet number display portion.

FIG. 3 shows a control circuit for the copying apparatus G which generally includes a CPU (central processing unit) 201 composed of a micro computer, and a RAM (random access memory) 208 and a switch matrix 204 constituted by the keys, etc. of the control panel 70 which are coupled with said CPU 201 as shown.

To output terminals A1, A2, A3, A4, A5, A6, A7 and A8 of the CPU 201, a main motor, a developing motor, timing rollers, upper and lower paper feed clutches, and transistors (not shown) for driving and switching various corona chargers, and a power source, etc. are connected so as to be controlled for on and off operation based on signals from said switch matrix 204. Moreover, various display portions are connected to the CPU 201 through a decoder 207 for controlling said display portions so as to be turned on or off.

In the RAM 208, data read from the IC card 98 (to be described later) and various other data necessary for the copying function of the copying apparatus are stored.

Meanwhile, the IC card 98 to be inserted through the IC card inserting slot 97 referred to earlier, is introduced into a connector 209 connected to a bus line of the CPU 201 so that reading and writing of the data may be effected by the instruction from said CPU 201. In the IC card 98, it is so arranged that data for each of a plurality of functioning with respect to various copying conditions such as number of copy paper sheets to be taken, magnification, paper size, density etc., are stored together with program numbers for identification of the respective modes. In the present embodiment, there are provided three kinds of functioning modes respectively marked with program numbers "1""2" and "3".

Referring further to flow-charts of FIGS. 4 and 5, processing procedures for the copying functions in the CPU 201 will be described hereinafter.

Before the explanation of the flow-charts, terms "on-edge" and "off-edge" will be defined as follows.

When the state of a switch, sensor, signal or the like is altered from "off" state to "on" state, such change in the state is defined as "on-edge".

Meanwhile, when the state of a switch, sensor, signal or the like is altered from "on" state to "off" state, such change n the state is defined as "off-edge".

Figure 4:
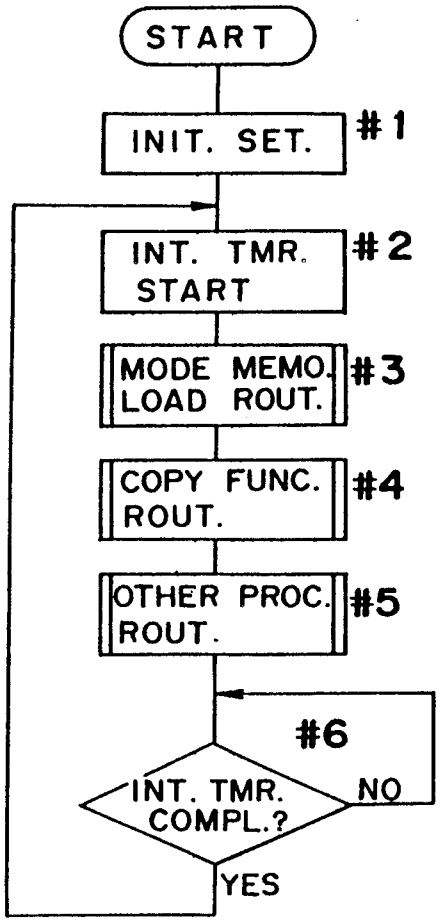

FIG. 4 schematically shows the overall arrangement for the processing by the CPU 201.

Upon starting of the program, with the power source turned on, the CPU 201 is set for the initial state at Step #1, together with the initial setting of all control subjects such as the initial setting of the number of copy paper sheets to be made to 1, returning of the original document platform to the starting position. At Step #2, an internal timer for defining a length of one routine is started.

Subsequently, a mode memory load routine (Step #3), copying function routine (Step #4), and other processing routines to effect processing for the input and display from the control panel 70 are successively executed (Step #5).

Upon completion of all sub-routine proceedings, one routine is finished after termination of the internal timer initially set (Step #6), and the procedure returns to Step #2 again.

Figure 5:
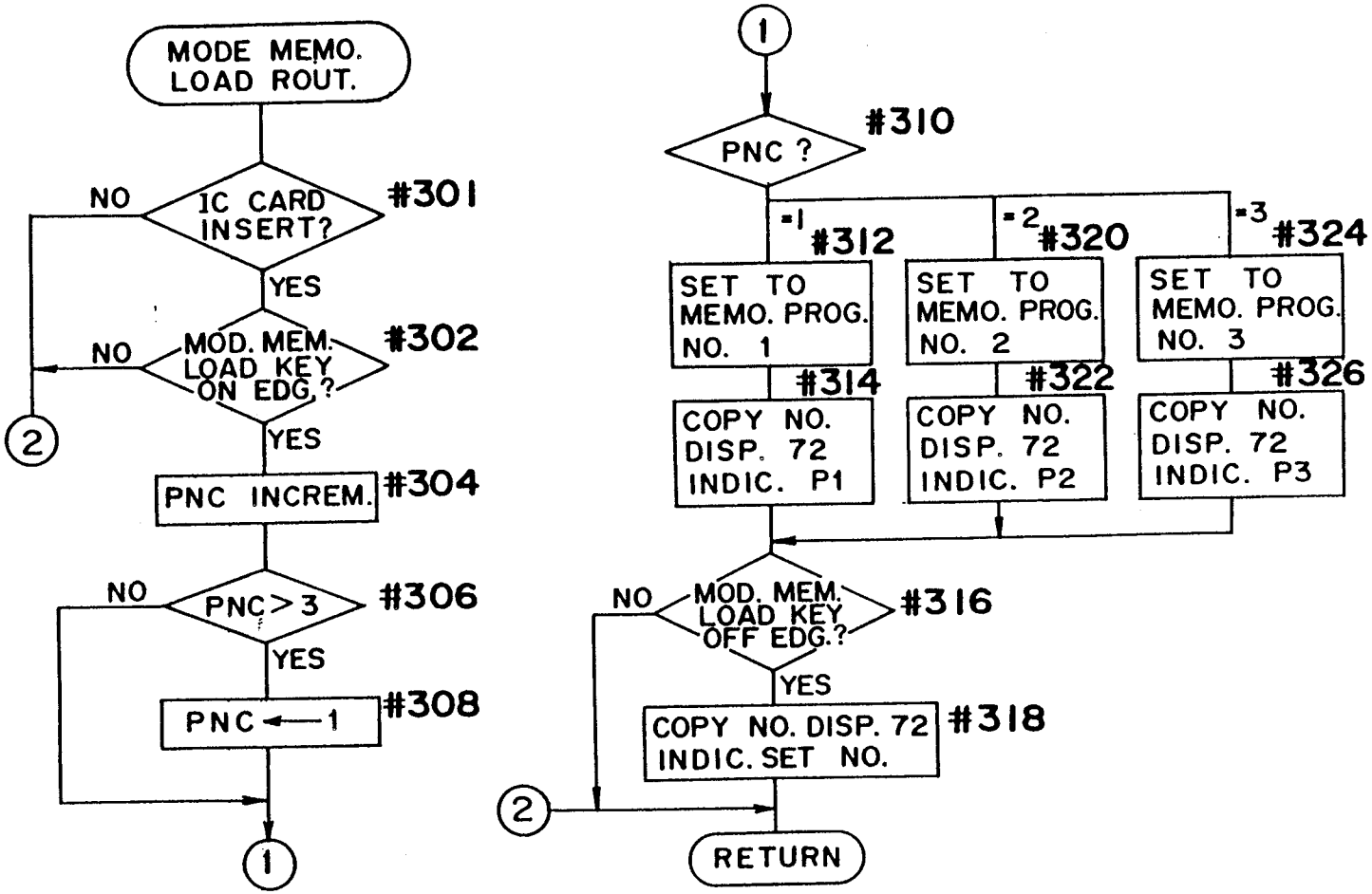

FIG. 5 is a flow-chart for showing the mode memory load routine.

At Step #301, it is checked whether or not the IC card 98 is inserted, and if the result is of "NO", the procedure is returned without effecting the subsequent proceedings.

In the case where the IC card 98 has been inserted, it is further judged whether or not the mode memory load key 96 is depressed (Step #302). Upon detection of an on-edge of the mode memory load key 96, a program number counter (PNC) is incremented (Step #304). When the program number counter exceeds "3", it is set to "1"(Steps #306 and 308).

Subsequently, according to the value of the program number counter, the procedure is branched into any of Step #312, 320 and 324.

When the program number counter is "1", the data for the functioning mode in which the program number is "1" is loaded from the IC card 98 to the RAM 208 (Step #312). Meanwhile, as shown in FIG. 6(*a*), and an identification symbol "P1" indicating that the program number is "1" is displayed on the sheet number display portion 72 (Step #314), whereby the copying apparatus is set to the mode in which the program number is "1".

Figure 6:
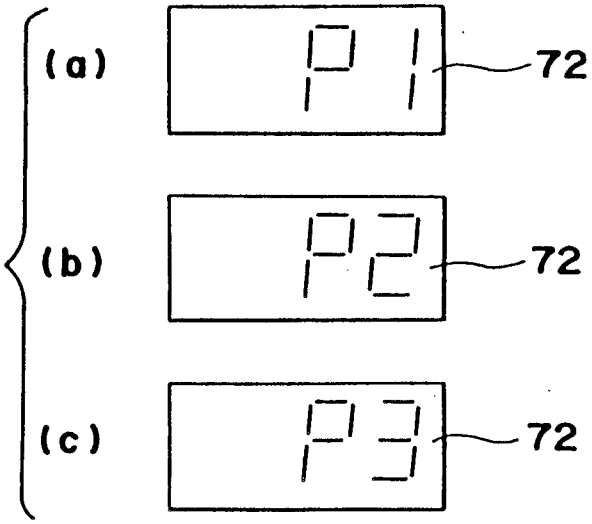

Processing similar to the above is also effected when the program number counter is "2" or "3"(Steps #320–326), and the identification "P2" or "P3" is displayed as shown in FIG. 6(*b*) or 6(*c*).

Upon detection of off-edge of the mode memory load key 96 (YES at Step #316), the program number indication (i.e., the identification symbol) displayed on the sheet number display portion 72 at Step #314, 322 or 326 is replaced by a display of the number of copy paper sheets to be mode, set to the selected mode (Step #318).

In the above embodiment, by inserting the IC card 98 through the IC card inserting slot 97 for connection with the connector 209, and then depressing the mode memory load key 96, any desired mode may be selected for setting from the plurality of modes stored in the IC card 98. Furthermore, since the respective modes are successively selected in a manner as in the rotation each time the mode memory load key 96 is depressed, with the program number for identifying the mode selected at that time being displayed, the operator may readily recognize the desired mode to be selected, and thus, the selection and setting of the modes are facilitated.

Figure 7:
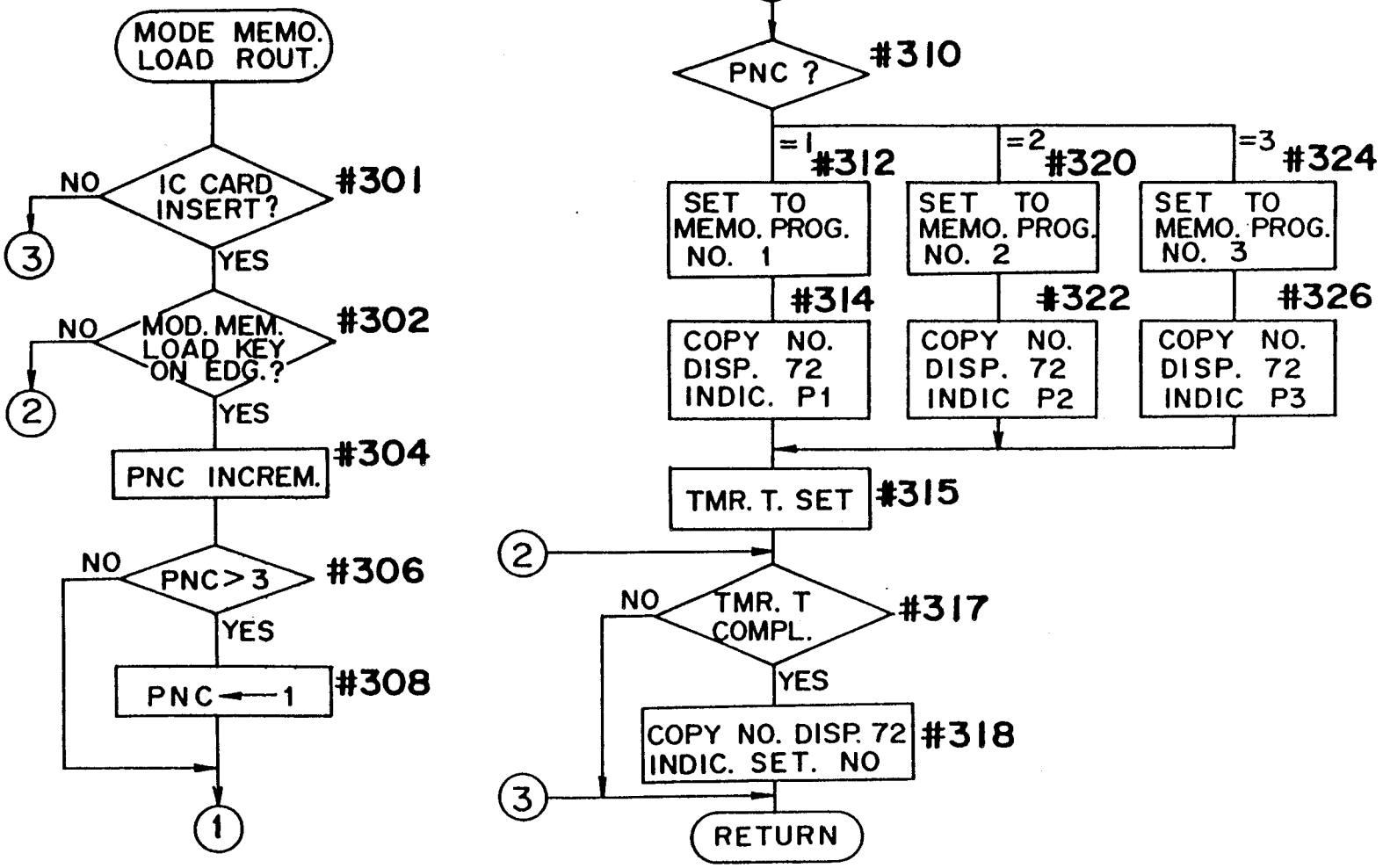
FIG. 7 is a flow chart showing a modification of a mode memory load routine shown in FIG. 5.

Referring further to FIG. 7, there is shown a modification of the mode memory load routine as described earlier with reference to FIG. 5, with like steps in FIG. 5 being designated by like step numbers for brevity of explanation.

The features of this modification in FIG. 7 reside in Steps #315 and #317, while other processings are generally similar to those shown in FIG. 5.

More specifically, in the embodiment of FIG. 7, in response to the on-edge of the mode memory load key 96 (Step #302), selected modes are set (Steps #312, #320 and #324), and the program numbers are displayed on the sheet number display portion 72 (Steps #314, #322, #326), with a timer T being further set (Step #315). The timer T is intended to define the timer for displaying the program number on the sheet number display portion 72. Upon termination of the timer T (Step #317), the number of copies set in the selected mode is displayed instead of the program number displayed on the sheet number display portion 72 (Step #318).

By the embodiment of FIG. 7, when the program is selected through depression of the mode memory load key 96, the program number is displayed on the display portion 72 during the period until the timer T terminates, and therefore it is not necessary of the operator to keep the mode memory load key depressing in order to ensure the program number, with a consequent improvement on the operability.

In any of the foregoing embodiments, since the sheet number display portion 72 is commonly used for indication of the program number, it is not necessary to separately provide a particular display portion for that purpose, and thus, a complicated and cluttered surface on the control panel can be prevented, with a simultaneous prevention of an increase in the manufacturing cost. Moreover, owing to the fact that only one mode memory load key 96 is required for the selection of modes, a complicated and cluttered control panel 70 is prevented as well, thus making it possible to reduce the manufacturing cost.

In the foregoing embodiments, although data for the three kinds of modes are adapted to be memorized, it may be so modified as to memorize data of two kinds or more than four kinds of modes. Meanwhile, for the program number display, numerals, alphabet, other characters, symbols or figures, etc. may be employed. These indications may be effected at a display portion other than the sheet number display portion 72, e.g. at a display portion adapted to display numerical values for the magnifications.

The IC card 98 described as employed in the foregoing embodiment as a memory medium may be replaced by a magnetic card, or an optical card such as a bar code, mark sheet or the like, or by a non-volatile semiconductor memory used in the interior of the copying apparatus.

As is clear from the foregoing description, according to the image forming apparatus of the present invention, it is possible to set any desired mode selected from a plurality of modes stored in the memory medium. Moreover, since the respective modes are successively selected each time the operating input means is operated, with the display of the identification symbol of the mode selected at that time being effected during the operation, the operator can readily recognize the mode desired to be selected, and thus, selection and setting of the mode may be readily effected.

Furthermore, since the sheet number display portion and the like can be commonly used as a display portion, the surface of the control panel can remain uncluttered and uncomplicated, thereby helping to prevent an increase in the manufacturing cost.

Although the present invention has been fully described by way of example with reference to the accompanying drawings, it is to be noted here that various changes and modifications will be apparent to to those skilled in the art. Therefore, unless otherwise such changes and modifications depart from the scope of the present invention, they should be construed as included therein.

What is claimed is:

1. A copying apparatus comprising: an image forming device for forming an image on a copy paper by designating one functioning mode of a plurality of functioning modes, a memory device which is detachable with respect to the image forming device and which stores a plurality of data associated with the plurality of functioning modes for setting the functioning mode of said image forming device, with the respective functioning modes being adapted to correspond to predetermined identification symbols, a mode selection device for selecting one of the functioning modes and the associated data stored in the memory device when said memory device is mounted with respect to said image forming device, and a display control means for displaying the identification symbol corresponding to the selected functioning mode on a display device that also displays information pertaining to the data associated with the selected functioning mode.

2. A copying apparatus as claimed in claim 1, wherein the identification symbols are of alphanumeric characters.

3. A copying apparatus as claimed in claim 1, wherein the information pertaining to the copying conditions of the selected functioning mode includes the number of copies to be made.

4. A copying apparatus as claimed in claim 1, wherein said mode selection device has one manual operating key to successively select the functioning mode and associated data stored in said memory device in response to the operation of said manual operating key.

5. A copying apparatus as claimed in claim 1, wherein said memory device is an IC card.

6. In an image forming apparatus arranged to selectively load data of a specific functioning mode from data of a plurality of functioning modes stored in a memory medium, through operation of an operating input means, the improvement comprising means for selecting one of the plurality of functioning modes stored in said memory medium by each operation of said input means, and a display control means for displaying an identification symbol of the functioning mode selected by said selecting means on a sheet number display portion during operation of said operating input means.

7. An image forming appartus comprising:

an image forming means for forming an image on copy paper according to one mode of a plurality of functioning modes, said functioning modes including a combination of a plurality of mode data;

memory means which is detachable with respect to the image forming means for storing a plurality of mode data for setting said functioning modes, each of said functioning modes being adapted to correspond to a predetermined identification symbol;

mode selection means for selecting one of the functioning modes and the associated mode data stored in the memory means when said memory means is mounted with respect to said image forming means; and display control means for displaying on the same display device, numbers related to the image forming operation when the image forming operation is executed in accordance with the mode data associated with the selected functioning mode and the identification symbol corresponding to the selected functioning mode selected through operation of said mode selection means.

8. In an image forming apparatus which is controlled by one of a plurality of functioning modes stored in a memory device which is detachably mounted with respect to said image forming apparatus, a method comprising the steps of:

mounting said memory device on said image forming apparatus, said memory device storing data which defines each of the functioning modes;

selecting one of said functioning modes stored in said memory device;

displaying an identification symbol related to the selected functioning mode on a display device that also displays information pertaining to the data associated with the selected functioning mode; and controlling the apparatus by the selected functioning mode.

* * * * *